US007938933B2

(12) United States Patent
Wang et al.

(10) Patent No.: US 7,938,933 B2
(45) Date of Patent: May 10, 2011

(54) METHOD FOR MAKING MINERAL FIBER PAPER

(75) Inventors: To-Mai Wang, Longtan Shiang (TW); Sheng-Fu Yang, Longtan Shiang (TW); Yung-Wou Lee, Longtan Shiang (TW); Kin-Seng Sun, Longtan Shiang (TW); Wen-Cheng Lee, Longtan Shiang (TW); Ching-Liang Chen, Longtan Shiang (TW); Chin-Ching Tzeng, Longtan Shiang (TW)

(73) Assignee: Atomic Energy Council—Institute of Nuclear Energy Research, Taoyuan (TW)

( * ) Notice: Subject to any disclaimer, the term of this patent is extended or adjusted under 35 U.S.C. 154(b) by 0 days.

(21) Appl. No.: 12/081,945

(22) Filed: Apr. 23, 2008

(65) Prior Publication Data

US 2011/0017414 A1 Jan. 27, 2011

(51) Int. Cl.

| | |
|---|---|
| ***D21H 13/00*** | (2006.01) |
| ***D21H 13/14*** | (2006.01) |
| ***D21H 13/36*** | (2006.01) |

(52) U.S. Cl. ..... 162/145; 162/146; 162/152; 162/168.1; 162/183

(58) Field of Classification Search ..... 162/145, 162/152, 156, 146, 168.1, 169, 183
See application file for complete search history.

(56) References Cited

U.S. PATENT DOCUMENTS

| | | | | |
|---|---|---|---|---|
| 3,035,965 | A * | 5/1962 | Mathews | 162/145 |
| 4,245,689 | A * | 1/1981 | Grard et al. | 162/134 |
| 4,318,774 | A * | 3/1982 | Powell et al. | 162/129 |
| 5,045,506 | A * | 9/1991 | Dube et al. | 501/35 |
| 6,346,168 | B1 * | 2/2002 | Kinsley, Jr. | 162/145 |

* cited by examiner

*Primary Examiner* — Eric Hug
*Assistant Examiner* — Peter Chin
(74) *Attorney, Agent, or Firm* — Jackson IPG PLLC; Demian K. Jackson

(57) ABSTRACT

Disclosed is a method for making fiber paper. In this method, mineral fibers and PVA resin are blended in water, thus forming first solution. Polymer fibers and PVA resin are blended in water, thus forming second solution. The first solution is mixed with the second solution. A wet paper-making machine is used to make mineral fiber paper from the mixture.

3 Claims, 2 Drawing Sheets

| | recipes |
|---|---|
| 1 | solution I : (mineral fiber 30% + 0.75gPVA resin)/400L water<br>solution II : (PE fiber 70% + 0.75gPVA resin)/400L water |
| 2 | solution I : (mineral fiber 35% + 0.75gPVA resin)/400L water<br>solution II : (PE fiber 65% + 0.75gPVA resin)/400L water |
| 3 | solution I : (mineral fiber 40% + 0.75gPVA resin)/400L water<br>solution II : (PE fiber 60% + 0.75gPVA resin)/400L water |
| 4 | solution I : (mineral fiber 45% + 0.75gPVA resin)/400L water<br>solution II : (PE fiber 55% + 0.75gPVAresin)/400L water |
| 5 | solution I : (mineral fiber 50% + 0.75gPVA resin)/400L water<br>solution II : (PE fiber 50% + 0.75gPVAresin)/400L water |

Fig. 1

| | stiffness test drape (cm) | tensile strength test | | refractory nature (grade) |
|---|---|---|---|---|
| | | stretch (%) | tensile strength (kgf) | |
| mineral fiber 30% PE fiber 70% | 22.5 | 2.4 | 24.1 | first grade |
| mineral fiber 35% PE fiber 65% | 22.8 | 3.1 | 24.3 | first grade |
| mineral fiber 40% PE fiber 60% | 22.9 | 4.9 | 26.9 | first grade |
| mineral fiber 45% PE fiber 55% | 23.2 | 4.9 | 34.9 | first grade |
| mineral fiber 50% PE fiber 50% | 23.0 | 4.7 | 30.3 | first grade |

Fig. 2

METHOD FOR MAKING MINERAL FIBER PAPER

FIELD OF THE INVENTION

The present invention relates to a method for making mineral fiber paper and, more particularly, to a method for making stiff, tensile and refractory mineral fiber paper.

DESCRIPTION OF THE RELATED ARTS

Disclosed in Taiwanese Patent No. 387958 is flammable fiber paper. Organic macromolecular fibers are mixed with flammable organic polymer fibrids to make fiber paper. It requires high temperature and high pressure to make this fiber paper. Hence, the cost is high. This fiber paper is refractory to a limited extent and cannot stand 330 degrees Celsius. Therefore, the use of this fiber paper is limited.

Disclosed in Taiwanese Patent I-274764 is cellulose-fiber compound. A 2-rolling mill is used to make slates from wooden fibers, dual mixture and thermoplastic resin. The slates are cut into grains. The grains are made into fibers in a conventional process. The fibers are made into fiber paper for use. The process for making this fiber paper is complicated and therefore expensive.

Disclosed in Taiwanese Patent I-250240 is a method for making refractory fiber paper and a pre-steeped article and laminate made of the refractory fibers. Refractory macromolecular fibers, aromatic polyamide fibers and adhesive are made into fiber paper. This fiber paper is isolating and refractory to a limited extent and cannot stand 400 degrees Celsius. It requires a lot of adhesive, and the cost is high.

Therefore, the present invention is intended to obviate or at least alleviate the problems encountered in prior art.

SUMMARY OF THE INVENTION

It is an objective of the present invention to provide a method for making stiff, tensile and refractory mineral fiber paper.

To achieve the foregoing objective, the method includes the step of blending mineral fibers and PVA resin in water, thus forming first solution. Polymer fibers and PVA resin are blended in water, thus forming second solution. The first solution is mixed with the second solution. A wet paper-making machine is used to make mineral fiber paper from the mixture.

Other objectives, advantages and features of the present invention will become apparent from the following description referring to the attached drawings.

BRIEF DESCRIPTIONS OF THE DRAWINGS

The present invention will be described via the detailed illustration of the preferred embodiment referring to the drawings.

FIG. 1 is a table of recipes for making fiber paper according to the preferred embodiment of the present invention FIG. 2 is table of properties of the fiber paper.

DESCRIPTION OF THE PREFERRED EMBODIMENT

There will be described a method for making fiber paper according to the preferred embodiment of the present invention. At first, a sort of mineral fibers is provided. This sort of mineral fibers is preferably water quenching slag.

The mineral fibers and 0.75 grams of PVA resin are evenly blended in 400 liters of water, thus providing solution I.

PE fibers and 0.75 grams of PVA resin are evenly blended in 400 liters of water, thus providing solution II.

Solutions I and II are mixed with each other. Blending is conducted at a speed of 80 rpm for period of 30 to minutes.

The mixture is fed into a wet paper-making machine. The conveying is conducted at a rate of 90 L/min. The networking is conducted at 4 m/min. Finally, drying is conducted at a temperature of 120 degrees Celsius for a period of 30 minutes.

In detail, plasma slag is made into the mineral fibers. There is 30 wt % to 50 wt % of mineral fibers. There is 70 wt % to 50 wt % of PE fibers or ordinary polymer fibers. The mineral fibers and the PE fibers are blended in 400 litters of water. The PVA resin is used as adhesive. 0.75 grams of PVA resin are blended in the solution. The fiber paper is compared with paper made of other recipes regarding stiffness (ASTM117-80), tensile strength (ASTM117-80) and refractory nature (CNS10285L-4).

The result is shown in FIG. 2. It is learned from the stiffness test that the drape is 22.5 to 23.2 cm. The drape is good. It is learned from the tensile strength test that the stretch is 2.4 to 4.9% and the tensile strength is 24.1 to 34.9 kgf. The stretch is low. The refractory nature is first grade. After combustion, the ash of the mineral fiber paper is not scattered and does not cause an environmental problem.

Therefore, the mineral fiber paper is stiff, strong and refractory, and can be used as a building material, refractory paper or a refractory material.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A method for making fiber paper comprising the steps of:

blending 30 wt % to 50 wt % of mineral fibers and resin in water, thus forming a first solution;

blending 70 wt % to 50 wt % of polymer fibers and resin in water, thus forming a second solution;

mixing the first solution with the second solution to form a mixture; and using a wet paper-making machine to make mineral fiber paper from the mixture.

2. The method according to claim 1, wherein the mineral fibers are made of water-quenching slag in a plasma melting furnace.

3. The method according to claim 1, wherein the first solution and the second solution both comprises 0.75 grams of resin blended in 400 liters of water.

* * * * *